US009058012B2

(12) United States Patent
Hanano et al.

(10) Patent No.: US 9,058,012 B2
(45) Date of Patent: Jun. 16, 2015

(54) PHOTOSENSITIVE DRUM UNIT, AND IMAGE FORMING APPARATUS USING THE SAME

(71) Applicant: KYOCERA DOCUMENT SOLUTIONS INC., Osaka (JP)

(72) Inventors: Susumu Hanano, Osaka (JP); Hirofumi Tsuji, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 13/943,859

(22) Filed: Jul. 17, 2013

(65) Prior Publication Data

US 2014/0161480 A1 Jun. 12, 2014

(30) Foreign Application Priority Data

Jul. 18, 2012 (JP) ..... 2012-159597

(51) Int. Cl.
*G03G 21/20* (2006.01)
*G03G 21/08* (2006.01)

(52) U.S. Cl.
CPC ..... *G03G 21/08* (2013.01)

(58) Field of Classification Search
CPC ..... G03G 21/1661
USPC ..... 399/92; 165/59
See application file for complete search history.

(56) References Cited

U.S. PATENT DOCUMENTS

| | | | | | |
|---|---|---|---|---|---|
| 4,674,859 | A * | 6/1987 | Iseki et al. | ..... | 399/122 |
| 2007/0189802 | A1* | 8/2007 | Maeda et al. | ..... | 399/101 |
| 2012/0027451 | A1* | 2/2012 | Shin | ..... | 399/98 |
| 2012/0045243 | A1* | 2/2012 | Nishikawa et al. | ..... | 399/92 |
| 2013/0108309 | A1* | 5/2013 | Yamanaka et al. | ..... | 399/92 |
| 2013/0142538 | A1* | 6/2013 | Miwa et al. | ..... | 399/92 |

FOREIGN PATENT DOCUMENTS

| | | | | | |
|---|---|---|---|---|---|
| JP | 05-188828 | A | | 7/1993 | |
| JP | H07-19752 | U | | 1/1995 | |
| JP | 07175338 | A | * | 7/1995 | ..... G03G 15/16 |
| JP | 2004-191477 | A | | 7/2004 | |
| JP | 2005-352228 | A | | 12/2005 | |
| JP | 2007318406 | A | * | 12/2007 | ..... H04N 1/04 |

* cited by examiner

*Primary Examiner* — Billy Lactaoen
*Assistant Examiner* — Arlene Heredia Ocasio
(74) *Attorney, Agent, or Firm* — Morgan, Lewis & Bockius LLP

(57) ABSTRACT

An image forming apparatus gas a photosensitive drum, an anti-static lamp, and a drum unit, The drum unit includes a unit main frame for holding the photosensitive drum, and a holder frame for holding the anti-static lamp, The holder frame is detachably attached to the unit main frame.

8 Claims, 7 Drawing Sheets

PHOTOSENSITIVE DRUM UNIT, AND IMAGE FORMING APPARATUS USING THE SAME

INCORPORATION BY REFERENCE

This application is based upon and claims the benefit of priority from the corresponding Japanese Patent Application No. 2012-159597 filed on Jul. 18, 2012, the entire contents of which are incorporated herein by reference.

BACKGROUND

The present disclosure relates to image forming apparatuses such as copiers, printers, and facsimile machines.

In a full-color image forming apparatus, on the circumferential surface of each of a plurality of photosensitive drums corresponding to different colors, namely yellow (Y), magenta (M), cyan (C), and black (BK) respectively, an electrostatic latent image is formed by use of a laser scanning unit, so that toner images of the different colors are formed with toner of the different colors.

The toner images of the different colors formed on the circumferential surfaces of the corresponding photosensitive drums are transferred one after another, in a superimposed fashion, onto an intermediary transfer belt that rotates endlessly. This produces a color image on the intermediary transfer belt. Subsequently, the color image formed on the intermediary transfer belt is transferred onto a sheet material such as a sheet of printing medium by use of a transfer roller. Then, the image transferred on the sheet material is pressed and heated by a fusing device to fuse the color image.

The photosensitive drum is built as a unit that can be integrally attached to and detached from the apparatus's main body. That is, the photosensitive drum is configured to be removable from the apparatus's main body on the occasion of maintenance etc. The drum unit that includes the photosensitive drum is provided with, in addition to the photosensitive drum, a cleaning blade, a charging device, an anti-static lamp, etc., and these can be, along with the photosensitive drum, taken out of the apparatus's main body.

Incidentally, when the light emitting portion of the anti-static lamp is contaminated with scattered toner, dust inside the apparatus, or the like, the amount of light drops, and insufficient static elimination results, producing a ghost image, for instance. Thus, the anti-static lamp requires regular cleaning.

For example, in connection with the cleaning of an anti-static lamp, there is known a configuration where a cleaning toner magazine is fitted with a cleaning member so that, when the magazine is replaced, the cleaning member automatically cleans the anti-static lamp.

However, an anti-static lamp is often arranged at a recessed position in a drum unit. This leads to the following problem: even with the conventional technology mentioned above, it is difficult to perform cleaning automatically on the occasion of replacement of the magazine. Also, the cleaning of an anti-static lamp arranged at such a recessed position is not easy even by human hands, and may require a special tool.

The present disclosure is made to overcome the inconveniences discussed above, and the aim of the present disclosure is to provide an image forming apparatus that allows easy cleaning of an anti-static lamp fitted to a drum unit.

SUMMARY

According to one aspect of the present disclosure, an image forming apparatus is provided with a drum unit which includes a photosensitive drum and an anti-static lamp. The drum unit includes a unit main frame which holds the photosensitive drum and a holder frame which holds the anti-static lamp and which is detachably attached to the unit main frame.

Further features and advantages of the present disclosure will become apparent from the description of embodiments given below.

DETAILED DESCRIPTION

Hereinafter, embodiments of the present disclosure will be described with reference to the accompanying drawings. The following description deals with copiers as image forming apparatuses according to the present disclosure.

(First Embodiment)

Figure 1:
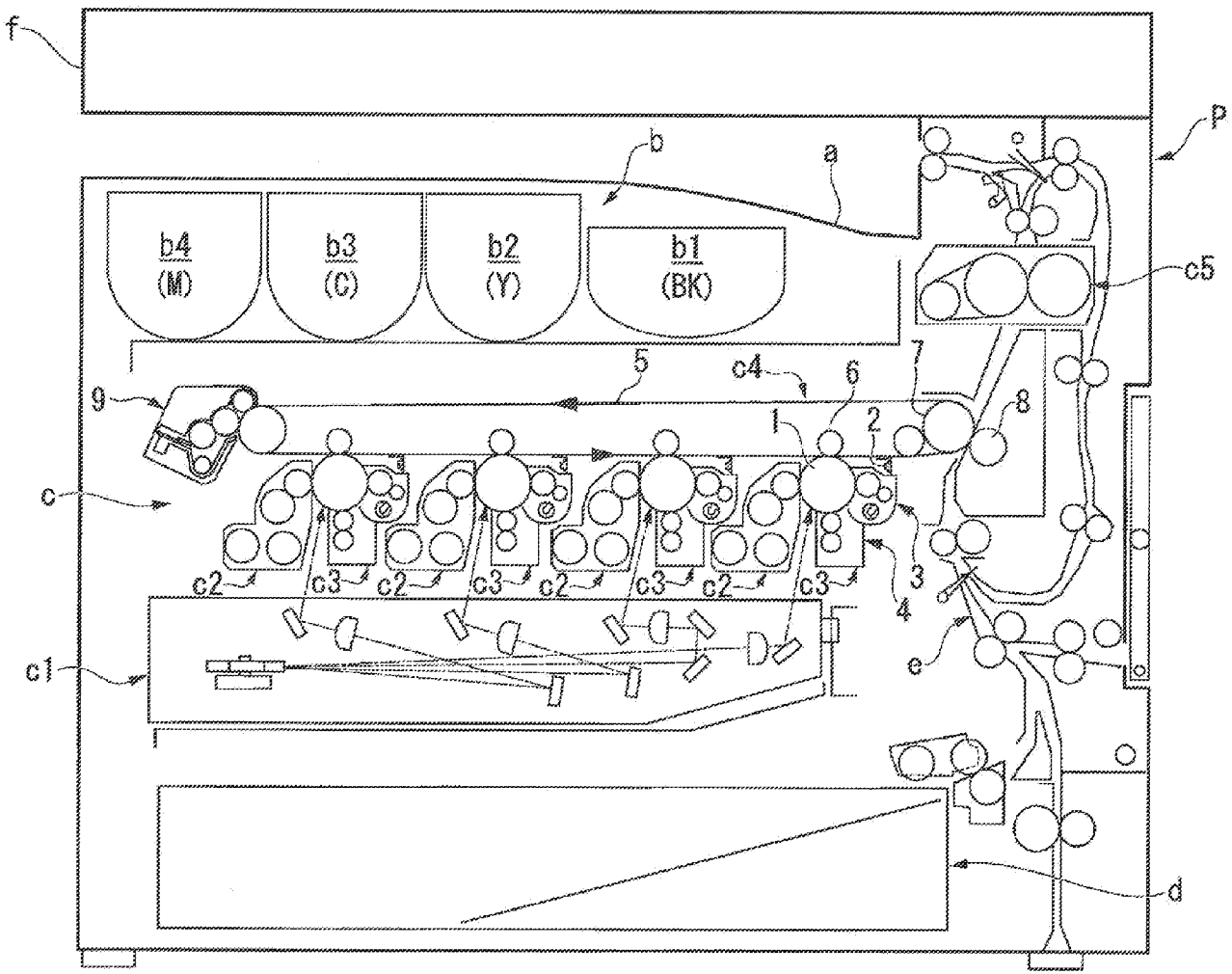
FIG. 1 is a schematic configuration diagram of a copier in a first embodiment of the present disclosure.

FIG. 1 is a schematic construction diagram of a copier P in a first embodiment of the present disclosure. The copier (image forming apparatus) P is provided with a discharge section a, a toner cartridge accommodation section b, an image formation section c, and a sheet section d. In the copier P, there is also provided a transport section e so as to extend from the sheet section d located in a lower part to the discharge section a located in an upper part. Moreover, in the copier P, over the discharge section a, there is provided a scanner section f for reading a document.

The discharge section a is configured such that sheets of a recording medium (a sheet material) having predetermined images formed on them are discharged onto it via the transport section e. The bottom face of the discharge section a is inclined, so that when a plurality of sheets are discharged, these can be stacked flush at one end.

The toner cartridge accommodation section b is configured such that a toner cartridge b1 for black toner (BK), a toner cartridge b2 for yellow toner (Y), a toner cartridge b3 for cyan toner (C), and a toner cartridge b4 for magenta toner (M) can be accommodated in it. The cartridges b1 to b4 are configured such that toner can be supplied to a developing unit c2 in the image formation section c.

The image formation section c is configured to include a laser scanning unit c1, developing units c2, drum units c3, a transfer unit c4, and a fusing unit c5. The developing units c2 are provided one for each of the cartridges bl to b4, and so are the drum units c3.

The laser scanning unit cl is, like a well-known laser scanning unit, configured to include a light beam generator, a polygon mirror, an fθ lens, etc. The light beam generator generates laser light. The polygon mirror scans the light beam emitted from the beam generator. The fθ lens etc. focuses the light beam scanned by the polygon mirror on a photosensitive drum 1, which will be described later.

The developing unit c2 supplies toner to the photosensitive drum 1, and thereby develops an electrostatic latent image formed on the circumferential surface of the photosensitive drum 1. The developing unit c2 is arranged opposite the circumferential surface of the photosensitive drum 1 in its radial direction.

The drum unit c3 has a photosensitive drum 1. On the circumferential surface of the photosensitive drum 1, an electrostatic latent image is formed by use of the laser scanning unit cl. On the circumferential surface of the photosensitive drum 1, a toner image is formed with toner supplied from the toner cartridge accommodation section b to the developing unit c2.

Around the photosensitive drum 1, there are provided, opposite it, an anti-static lamp 2, a cleaner 3, and a charger 4. The anti-static lamp 2 removes electric charge from the circumferential surface of the photosensitive drum 1 after transfer. The cleaner 3 removes toner remaining on the circumferential surface of the photosensitive drum 1 after transfer. The charger 4 electrically charges the circumferential surface of the photosensitive drum 1 before transfer. In this embodiment, the anti-static lamp 2, the cleaner 3, and the charger 4 are, along with the photosensitive drum 1, built into a unit, namely the drum unit c3, that can be integrally attached and detached.

The transfer unit c4 has an intermediary transfer belt 5, a primary transfer roller 6, secondary transfer rollers 7 and 8, and a cleaner 9. Onto the intermediary transfer belt 5, a toner image is transferred from the photosensitive drum 1. The primary transfer roller 6 is arranged opposite the photosensitive drum 1 across the intermediary transfer belt 5. The secondary transfer rollers 7 and 8 secondarily transfer the toner image transferred onto the intermediary transfer belt 5. The cleaner 9 cleans the intermediary transfer belt 5. When a predetermined sheet material, such as a sheet of a recording medium, is transported in via the transport section e, the secondary transfer rollers 7 and 8 rotate with the sheet and the intermediary transfer belt 5 interposed between them. This achieves secondary transfer onto the sheet, which can then be transported toward the fusing unit c5.

The fusing unit c5 is provided on the downstream side of where the transfer unit c4 is provided, in part of the transport section e. The fusing unit c5 is composed of a pair of rollers arranged so as to nip the sheet transported in the transport section e. The fusing unit c5 is configured such that it can press and heat the sheet with that pair of rollers so that the toner image transferred onto the sheet in the transfer unit c4 is fused onto the sheet.

The sheet section d is a sheet feed cassette which is provided in the apparatus cabinet such that it can be pulled out. The sheet section d is configured such that it can supply sheets one by one from the paper feed cassette to the transport section e. The transport section e is provided so as to extend from the sheet section d located in a lower part to the discharge section a located in an upper part, and is configured to have a plurality of transport rollers and guide plates. The transport section e is configured such that it can transport sheets supplied from the sheet section d one by one toward the discharge section a.

In the copier P configured as described above, laser light corresponding to image data is irradiated from the laser scanning unit c1 onto the photosensitive drum 1 to form an electrostatic latent image, and a toner image is developed with supplied toner. The toner image carried on the photosensitive drum 1 is transferred onto a sheet by the transfer unit c4, and is then pressed and heated so as to be fused. Ultimately, the sheet having the image printed on it is discharged onto the discharge section a.

Figure 2:
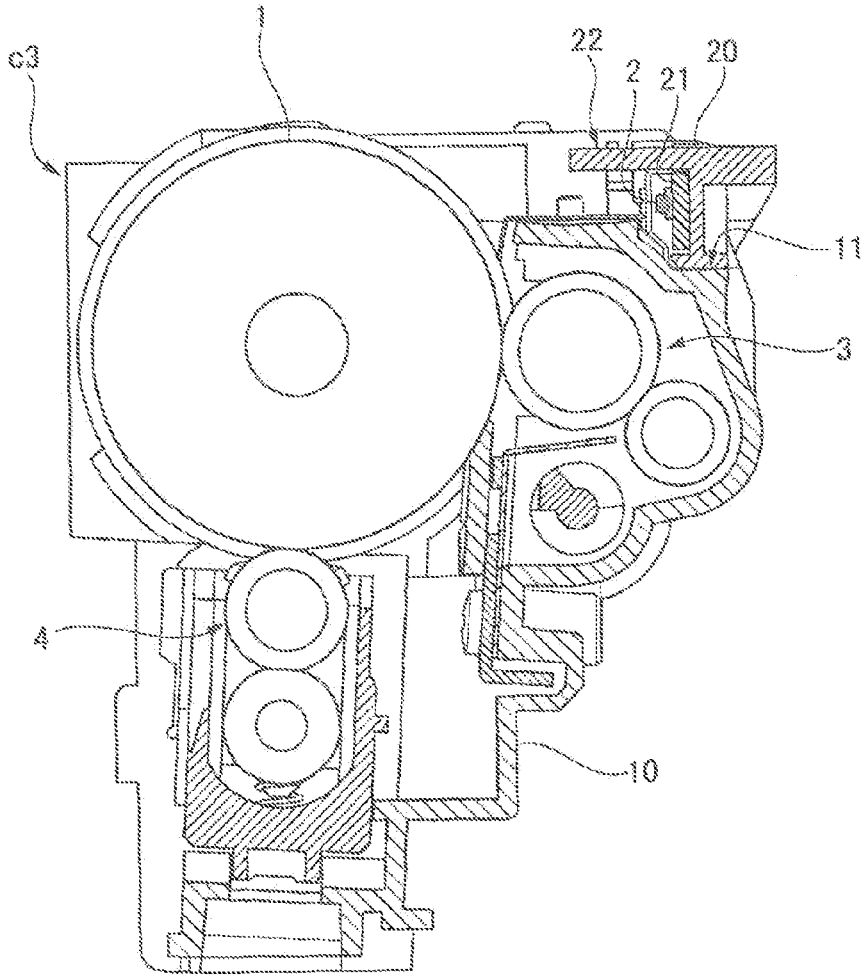
FIG. 2 is a sectional view showing a configuration of a drum unit in the first embodiment of the present disclosure.
Figure 3:
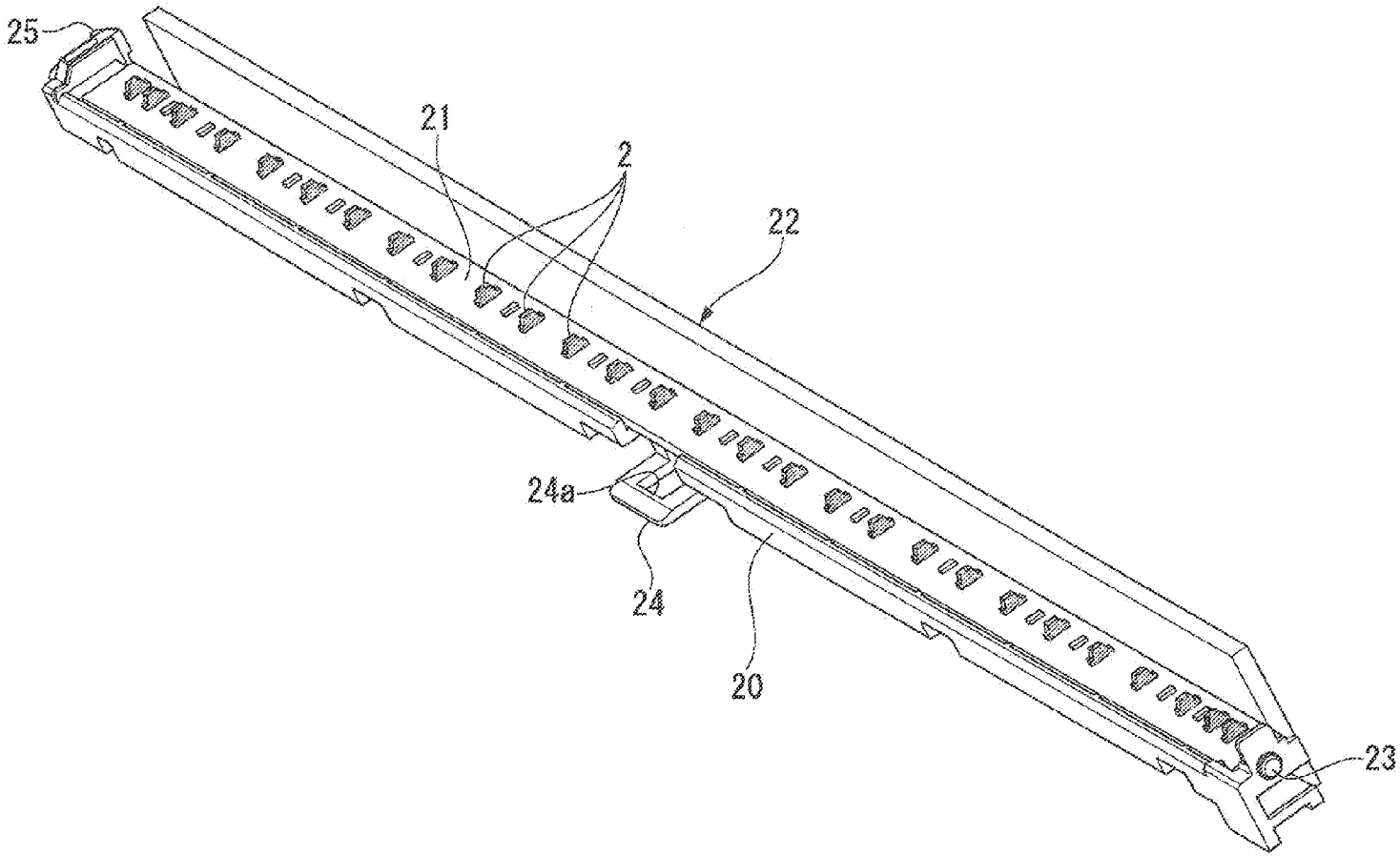
FIG. 3 is a perspective view showing a configuration of an anti-static lamp and a holder frame in the first embodiment of the present disclosure.
Figure 4:
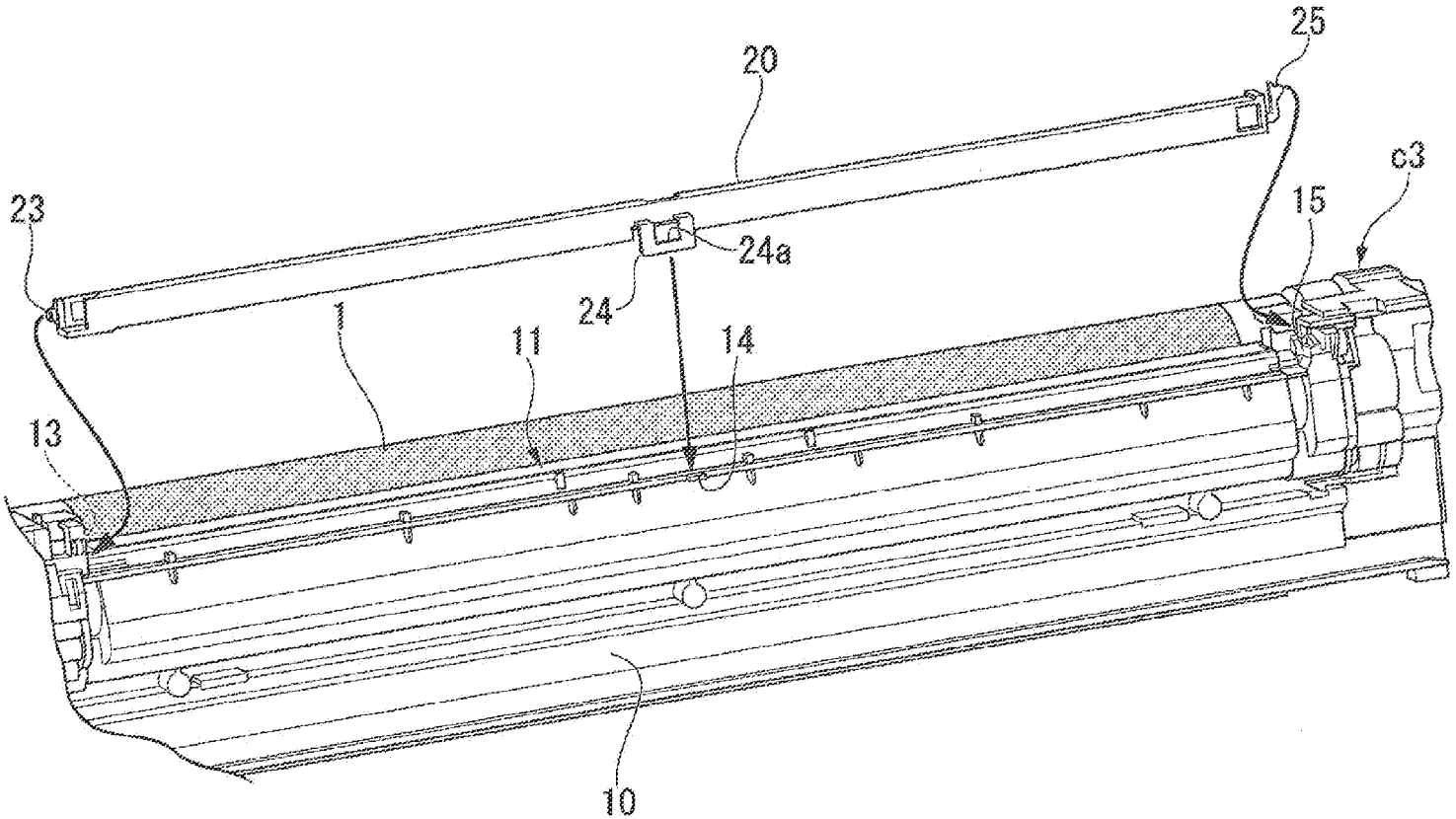
FIG. 4 is a diagram in illustration of how a holder frame is fitted in the first embodiment of the present disclosure.

Next, with reference to FIGS. 2 to 4, the configuration of the drum unit c3 will be described. FIG. 2 is a sectional view showing the configuration of the drum unit c3 in the first embodiment of the present disclosure . FIG. 3 is a perspective view showing the configuration of an anti-static lamp 2 and a holder frame 20 in the first embodiment of the present disclosure. FIG. 4 is a diagram in illustration of how the holder frame 20 is fitted in the first embodiment of the present disclosure, in a perspective view as seen from the right side of the plane of FIG. 2.

As shown in FIG. 2, the drum unit c3 is configured to include a photosensitive drum 1 and an anti-static lamp 2. In this embodiment, the drum unit c3 is configured to further include a cleaner 3 and a charger 4. In the drum unit c3, the components are arranged around the photosensitive drum 1. Thus, in the drum unit c3, the arrangement of the anti-static lamp 2, the cleaner 3, and the charger 4 is determined relative to the photosensitive drum 1.

In the drum unit c3, the anti-static lamp 2, the cleaner 3, and the charger 4 are arranged opposite the photosensitive drum 1. In this embodiment, the anti-static lamp 2 is a light-emitting diode (LED). To secure a satisfactorily large irradiated area, the anti-static lamp 2 is arranged farther away from the photosensitive drum 1 than the other components. Moreover, to suppress leakage of light, which leads to a loss in the amount of light, an overhang portion 22 is provided over the anti-static lamp 2, which is thus arranged in a recessed position in the drum unit c3.

The drum unit c3 has a unit main frame 10 which holds the photosensitive drum 1. The unit main frame 10 is configured to hold the photosensitive drum 1, the cleaner 3, and the charger 4 integrally. The cleaner 3 is arranged to a side of the photosensitive drum 1, and the charger 4 is arranged under the photosensitive drum 1. The part of the unit main frame 10 where the cleaner 3 is arranged protrudes outward so as to form a support portion 11 for supporting the anti-static lamp 2.

The drum unit c3 has a holder frame 20 which holds the anti-static lamp 2. The holder frame 20 includes the overhang portion 22, and is formed in a T-shape as seen in a sectional view. In this embodiment, as shown in FIG. 3, the anti-static lamp 2 comprises a plurality of lamps arranged on the holder frame 20 in its longer-side direction (the predetermined direction). The plurality of anti-static lamps 2 are mounted integrally on a base 21. This base 21 is fitted to the holder frame 20, and thereby the plurality of anti-static lamps 2 are held on the holder frame 20.

The holder frame 20 is detachably attached to the unit main frame 10. In this embodiment, as shown in FIG. 4, the holder frame 20 is detachably attached to a support portion 11 of the unit main frame 10. Thus, the anti-static lamp 2 and the holder frame 20 are integrally removable from the drum unit c3. In this embodiment, the holder frame 20 is fitted to the unit main frame 10 by press-fitting.

As shown in FIG. 3, the holder frame 20 has a positioning pin 23. The positioning pin 23 is provided integrally in one end part of the holder frame 20 in its longer-side direction (the predetermined direction). The positioning pin 23 protrudes outward in the longer-side direction of the holder frame 20. As shown in FIG. 4, the positioning pin 23 can fit into a positioning hole 13 in the unit main frame 10.

As shown in FIG. 3, the holder frame 20 has a locking tab 24. The locking tab 24 is provided integrally in a central part of the holder frame 20 in its longer-side direction. The locking tab 24 protrudes in the shorter-side direction of the holder frame 20 (the direction perpendicular to the predetermined direction), and has a rectangular locking hole 24*a*. As shown in FIG. 4, a projection 14 on the unit main frame 10 can fit in this locking hole 24a.

As shown in FIGS. 3 and 4, the holder frame 20 has a hook 25. The hook 25 is provided in another end part of the holder frame 20 in its longer-side direction. The hook 25 is bent in the other end part of the holder frame 20 in its longer-side direction, and extends in the direction opposite to the direction in which the locking tab 24 protrudes. The pointed end of the hook 25 points in that opposite direction, that is, upward. As shown in FIG. 4, the hook 25 can fit in a stopping hole 15 in the unit main frame 10.

With the drum unit c3 configured as described above, the holder frame 20 can be detachably attached to the unit main frame 10. Specifically, as shown in FIG. 4, detachable attachment is achieved by fitting and releasing at three places, namely fitting between the positioning pin 23 and the positioning hole 13, fitting between the locking tab 24 and the projection 14, and fitting between the hook 25 and the stopping hole 15. With this fitting structure, it is possible to reduce the number of components needed as compared with, for example, a structure involving fastening with screws, and thus to eliminate the need for a tool such as a screwdriver. Thus, it is possible to easily separate and remove the anti-static lamp 2 along with the holder frame 20 from the unit main frame 10.

As described above, in this embodiment, the holder frame 20 is provided which holds the anti-static lamp 2 and which is detachably attached to the unit main frame 10. Thus, even when the light emitting portion of the anti-static lamp 2 is contaminated with scattered toner, dust inside the apparatus, or the like, the anti-static lamp 2 along with the holder frame 20 can be separated and removed from the unit main frame 10. Thus, even such an anti-static lamp 2 as is arranged in a recessed position when assembled into the drum unit c3 can be cleaned easily.

As shown in FIG. 3, under the anti-static lamp 2 removed, there is a wide open space, and thus, without the use of a special tool, toner or the like deposited on the light emitting portion of the anti-static lamp 2 can be easily wiped off Moreover, even if part of the anti-static lamp 2 is faulty or broken by some cause, it can be removed for easy replacement. In a case where, as in this embodiment, the anti-static lamp 2 comprises a plurality of lamps, they have varying lifetimes, and some may even have shorter lifetimes than the photosensitive drum 1. Even in such a case, the anti-static lamp 2 alone can be separated from the drum unit c3, and this eliminates the need to replace the entire drum unit c3, allowing efficient maintenance and reducing the replacement cost.

Thus, according to the embodiment described above, in a copier P having a drum unit c3 including a photosensitive drum 1 and an anti-static lamp 2, the drum unit c3 has a unit main frame 10 and a holder frame 20. The unit main frame 10 holds the photosensitive drum 1. The holder frame 20 holds the anti-static lamp 2, and is detachably attached to the unit main frame 10. By adopting this configuration, it is possible to obtain a copier P that allows easy cleaning of the anti-static lamp 2 fitted to the drum unit c3.

(Second Embodiment)

Next, a second embodiment of the present disclosure will be described. In the following description, such parts as are identical with or equivalent to those in the embodiment described above are identified by the same reference signs, and their description will be cut short or omitted.

Figure 5:
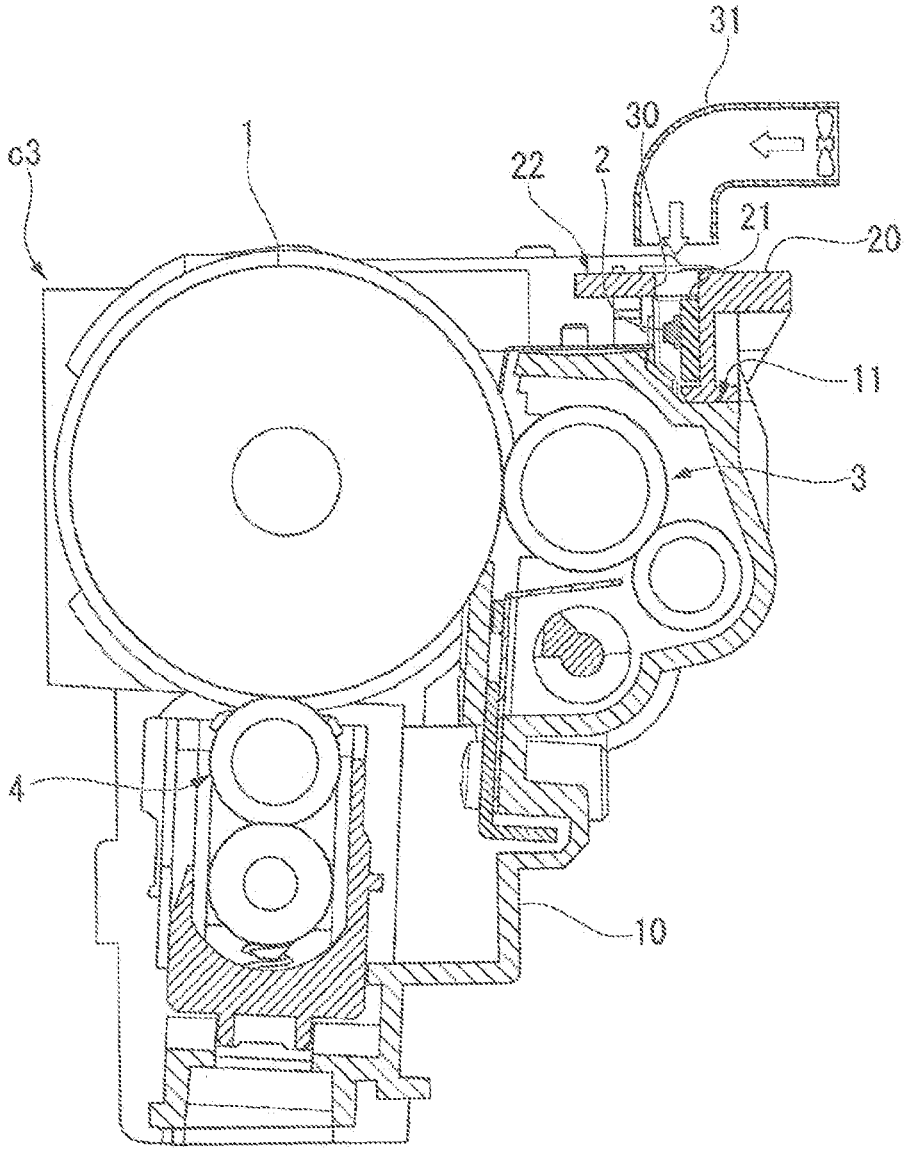
FIG. 5 is a sectional view showing a configuration of a drum unit in a second embodiment of the present disclosure.
Figure 6:
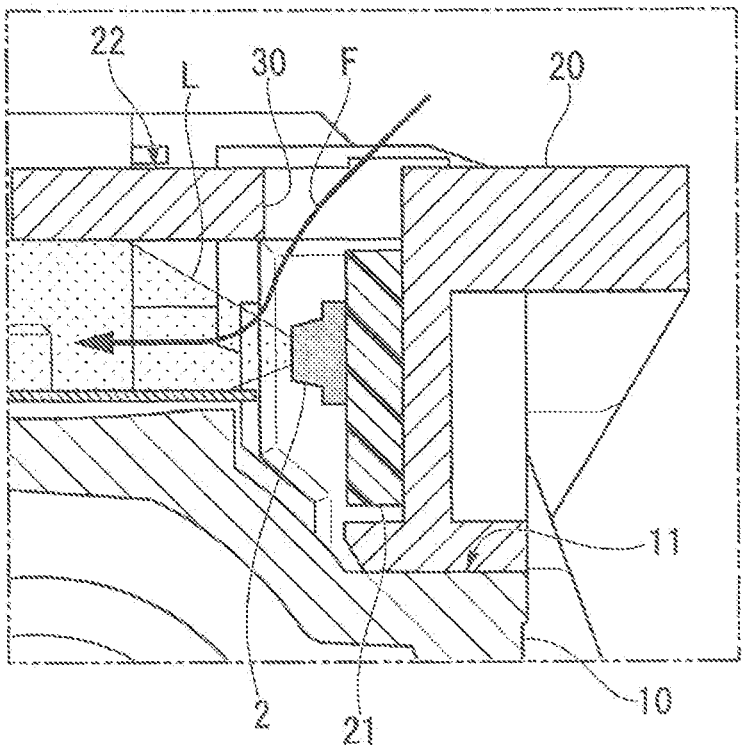
FIG. 6 is a sectional view showing a configuration of a holder frame in the second embodiment of the present disclosure.
Figure 7:
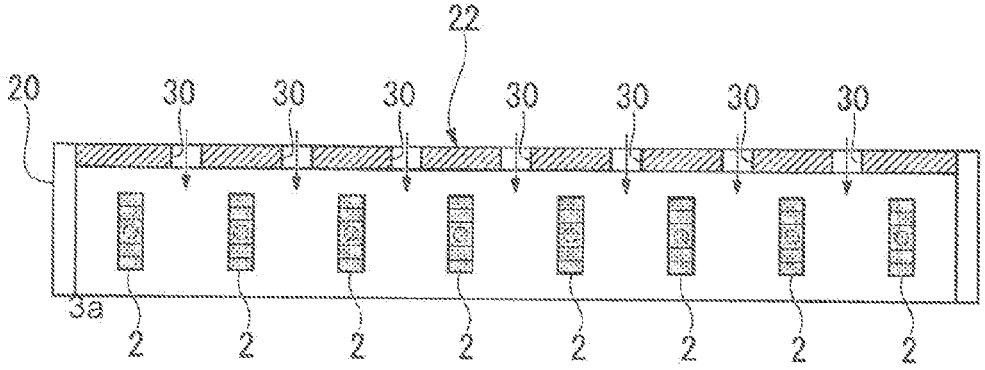
FIG. 7 is a schematic diagram in illustration of an arrangement of openings provided in a holder frame in its longer-side direction in the second embodiment of the present disclosure.

FIG. 5 is a sectional view showing the configuration of a drum unit c3 in the second embodiment of the present disclosure. FIG. 6 is a sectional view showing the configuration of a holder frame 20 in the second embodiment of the present disclosure. FIG. 7 is a schematic diagram in illustration of an arrangement of openings 30 provided in the holder frame 20 in its longer-side direction in the second embodiment of the present disclosure. The second embodiment differs from the embodiment described above in that there is provided an opening 30 for forming a stream of air F (see FIG. 6) in the direction in which the light from the anti-static lamp 2 is radiated.

Inside the cabinet of the copier P, to prevent the temperature of the constituent components from becoming excessively high due to the heat they generate, a stream of air (gas) is formed with a fan or the like. In the second embodiment, a configuration is adopted where this air stream is exploited to reduce contamination of the anti-static lamp 2. As shown in FIG. 5, the holder frame 20 has an opening 30. The opening 30 is formed in the overhang portion 22. To form an air stream with high directivity in the direction in which the light from the anti-static lamp 2 is directed, it is preferable to arrange a blow duct (blowing device) 31 to guide the air blown from the fan toward the opening 30.

As shown in FIG. 6, the opening 30 is arranged at a position where it is not irradiated with the light (indicated by the reference sign L in FIG. 6) of the anti-static lamp 2. The opening 30 is arranged at a position recessed from the light-irradiated range which fans radially from the light emitting portion of the anti-static lamp 2 toward the photosensitive drum 1. In this embodiment, the opening 30 is open vertically over the anti-static lamp 2. As described above, the anti-static lamp 2 comprises a plurality of lamps held in the longer-side direction. As shown in FIG. 7, the holder frame 20 has a plurality of openings 30 arranged between the anti-static lamps 2 in the longer-side direction.

According to the second embodiment configured as described above, the opening 30 is formed in the holder frame 20, and as shown in FIG. 6, the air stream F is formed in the direction in which the light of the anti-static lamp 2 is directed. With this air stream F, it is possible to suppress contamination of the anti-static lamp 2. The direction in which the light from the anti-static lamp 2 is directed is open, being clear of the unit main frame 10 and the holder frame 20. From this open direction, toner flies in from the photosensitive drum 1. Thus, by forming the air stream F against the toner flying in, it is possible to suppress contamination of the anti-static lamp 2.

Moreover, in the second embodiment, the opening 30 is arranged at a position where it is not irradiated with the light from the anti-static lamp 2, and this helps prevent leakage of the light from the anti-static lamp 2 through the opening 30 and hence a loss in the amount of light. Thus, it is possible to prevent insufficient removal of charge as may produce a ghost image. Moreover, Even in a case where the anti-static lamp 2 comprises a plurality of lamps, as shown in FIG. 7, arranging openings 30 between adjacent anti-static lamps 2 helps prevent leakage of the light from the anti-static lamp 2 through the openings 30. Moreover, with the air stream through the openings 30, it is possible to suppress contamination of the anti-static lamps 2 arranged on both sides of each of them.

That is, as shown in FIG. 6, although the light from the anti-static lamp 2 has predetermined directivity, not a little scattering does occur. This causes, in the arrangement shown in FIG. 7, slant incidence when scattered light passes through the openings 30. This reduces the apparent opening area of the openings 30, and helps suppress direct leakage of scattered light through the openings 30.

According to the second embodiment described above, the openings 30 is provided, in the holder to which the anti-static lamp 2 is fitted, at a position where the openings 30 is not irradiated with the light from the anti-static lamp 2. Thus, it is possible, by use of the opening, to blow air toward the photosensitive drum 1, and thereby to prevent contamination of the light emitting portion of the anti-static lamp 2 with scattering toner, dust inside the apparatus, or the like. Moreover, a configuration is adopted that permits the anti-static lamp 2 along with the holder frame 20 to be easily removable integrally from the drum unit c3. Thus, the light emitting portion can be cleaned directly. This eliminates the need for a transparent cover or the like for the light emitting portion, and thus helps realize a configuration that is advantageous in terms of cost.

(Third Embodiment)

Next, a third embodiment of the present disclosure will be described. In the following description, such parts as are identical with or equivalent to those in the embodiments described above are identified by the same reference signs, and their description will be cut short or omitted.

Figure 8:
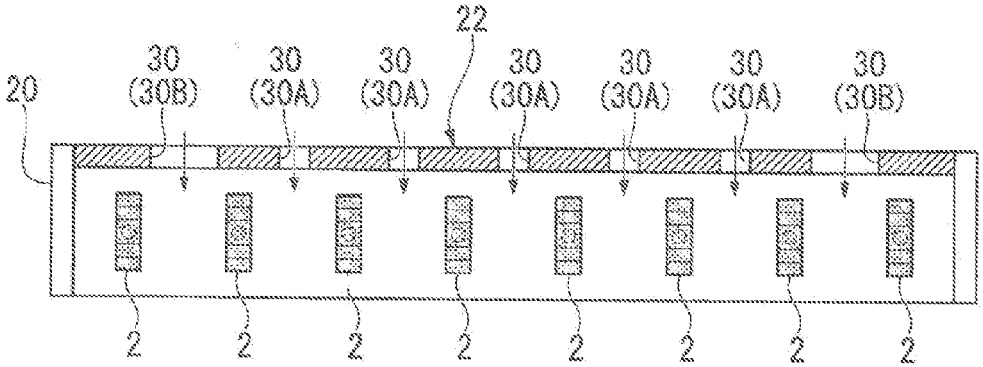
FIG. 8 is a schematic diagram in illustration of an arrangement of openings provided in a holder frame in its longer-side direction in a third embodiment of the present disclosure.

FIG. 8 is a schematic diagram in illustration of an arrangement of openings 30 provided in a holder frame 20 in its longer-side direction in the third embodiment. The third embodiment differs from the embodiment described above in that, as shown in FIG. 8, the holder frame 20 has a first opening 30A with a predetermined size and a second opening 30B with a larger size than the first opening 30A.

The first and second openings 30A and 30B are, as in the embodiment described above, for forming a stream of air in the direction in which the light from the anti-static lamp 2 is directed. The first and second openings 30A and 30B are provided in the overhang portion 22 of the holder frame 20. Two second openings 30B are arranged one at each end of the holder frame 20 in its longer-side direction, and a plurality of first openings 30A are arranged elsewhere.

According to the third embodiment, the plurality of openings 30 arranged in the longer-side direction include first openings 30A with a predetermined size and second openings 30B with a larger size than the first openings 30A. Moreover, the second openings 30B are arranged at both ends in the longer-side direction. Around the anti-static lamps 2 arranged at both ends in the longer-side direction, air tends to stagnate and thus toner tends to deposit, making those areas prone to be easily contaminated. Thus, by arranging the second openings 30B at both ends in the longer-side direction and thereby increasing the opening area at both ends, it is possible to increase the amount of passing air and make air less prone to stagnate. Thus, according to the third embodiment, it is possible to efficiently suppress contamination of the anti-static lamp 2.

It should be understood that the preferable embodiments of the present disclosure described above with reference to the drawings are not meant to limit the present disclosure in any way. The shapes, combinations, etc. of various components specifically mentioned in the embodiments described above are merely examples, and allow for many modifications and variations within the spirit of the present disclosure.

For example, although the above embodiments deal with cases where the holder frame is detachably attached to the unit main frame by press-fitting, the detachable attachment may instead be achieved by use of screws or the like.

Although the above embodiments deal with cases where no transparent cover is provided between the photosensitive drum and the anti-static lamp, it is also possible to adopt a configuration where the holder frame is fitted with a transparent cover so that these can be integrally removable from the drum unit.

Although the above embodiments deal with cases where a blow duct is used as a blowing device, in a case where components are densely arranged around the anti-static lamp 2, it is also possible to adopt a configuration where air is blown out of a fine pipe through a nozzle. It is also possible to adopt a configuration where air from a fan is blown into a gap between components (a gap extending in the axial direction of the photosensitive drum) so that, with that gap used as an air passage, air is blown to openings arranged in the longer-side direction (the axial direction).

Although the above embodiments deal with copiers as image forming apparatuses, the present disclosure is also applicable to image forming apparatuses such as printers and facsimile machines.

What is claimed is:

1. An image forming apparatus, comprising a photosensitive drum, an anti-static lamp, and a drum unit, the drum unit including a unit main frame for holding the photosensitive drum, and a holder frame for holding the anti-static lamp, the holder frame being detachably attached to the unit main frame, wherein:

the holder frame has an opening for forming an air stream in a direction in which light from the anti-static lamp is directed, the holder frame holds, as the anti-static lamp, a plurality of anti-static lamps arranged in a predetermined direction, the holder frame has, as the opening, a plurality of openings arranged in the predetermined direction, between the anti-static lamps, the plurality of openings comprise a first opening with a predetermined size and a second opening with a larger size than the first opening, the second opening is arranged at each end of the predetermined direction, the opening is arranged over the anti-static lamp and is open to face the anti-static lamp, the holder frame is provided with a transparent cover, and the transparent cover is arranged between the photosensitive drum and the anti-static lamp.

2. The image forming apparatus according to claim 1, wherein the holder frame is detachably attached to the unit main frame by press-fitting.

3. The image forming apparatus according to claim 1, wherein the opening is arranged at a position where the opening is not irradiated by the light of the anti-static lamp.

4. The image forming apparatus according to claim 1, further comprising a blowing device for blowing air to the opening.

5. The image forming apparatus according to claim 2, wherein the holder frame has a positioning pin provided in one end part of the holder frame in the predetermined direction so as to protrude outward, a locking tab provided so as to protrude from a central part of the holder frame in the predetermined direction and having a rectangular locking hole, and a hook provided in another end part of the holder frame in the predetermined direction so as to extend in a direction opposite to a direction in which the locking tab protrudes, and the positioning pin, the locking hole, and the hook are each detachably attached to the unit main frame via a respective fitting structure.

6. The image forming apparatus according to claim 5, wherein the opening is arranged at a position where the opening is not irradiated by the light of the anti-static lamp.

7. The image forming apparatus according to claim 5, further comprising a blowing device for blowing air to the opening.

8. The image forming apparatus according to claim 1, wherein the opening is provided in an overhang portion provided over the anti-static lamp.

* * * * *